US007810683B2

(12) United States Patent
Chan

(10) Patent No.: US 7,810,683 B2
(45) Date of Patent: Oct. 12, 2010

(54) CARRIER FOR HANDHELD DEVICE

(76) Inventor: Te-Erh Chan, No. 105, Da-Bei Rd., Taipei (TW)

( * ) Notice: Subject to any disclaimer, the term of this patent is extended or adjusted under 35 U.S.C. 154(b) by 486 days.

(21) Appl. No.: 11/878,157

(22) Filed: Jul. 20, 2007

(65) Prior Publication Data

US 2009/0020570 A1 Jan. 22, 2009

(51) Int. Cl.
*A45F 5/00* (2006.01)

(52) U.S. Cl. ..... 224/222; 224/221; 224/250; 224/267; 224/930; 224/901.8

(58) Field of Classification Search ..... 224/219, 224/221, 222, 267, 930, 676, 250, 901.8; 206/320; D3/218
See application file for complete search history.

(56) References Cited

U.S. PATENT DOCUMENTS 4,751,923 A * 6/1988 Marino ..... 602/4
4,763,821 A * 8/1988 Powell ..... 224/267
4,896,805 A * 1/1990 Klaczak et al. ..... 224/236
5,775,497 A * 7/1998 Krulik ..... 206/320
5,941,434 A * 8/1999 Green ..... 224/250
6,182,878 B1 2/2001 Racca ..... 224/605
6,330,430 B1 * 12/2001 Jensfelt ..... 455/575.8
6,772,879 B1 * 8/2004 Domotor ..... 206/45.23
6,892,880 B2 * 5/2005 Nieves ..... 206/320
6,896,134 B2 * 5/2005 Russell et al. ..... 206/320
7,099,710 B1 * 8/2006 Faillance ..... 455/575.8
2007/0215663 A1 * 9/2007 Chongson et al. ..... 224/930
2008/0017678 A1 * 1/2008 Anderson et al. ..... 224/221
2008/0223889 A1 * 9/2008 Rossell et al. ..... 224/222

* cited by examiner

*Primary Examiner*—Justin M Larson
(74) *Attorney, Agent, or Firm*—WPAT, PC; Justin King

(57) ABSTRACT

A carrier includes a base and a clear plastic top member connected to the base via a plurality of spaced binding bands with a receiving space formed between them for holding a handheld video device therein, and an arm band extended across and releasably secured to a lower side of the base for binding the carrier around a user's arm. The binding bands are length adjustably connected at a proximal end to peripheral edges of the top member, and are provided on a back side with a hook fastener surface each for releasably securing to loop fastener surfaces provided on the lower side of the base.

5 Claims, 8 Drawing Sheets

CARRIER FOR HANDHELD DEVICE

FIELD OF THE INVENTION

The present invention relates to a carrier for handheld device, and more particularly to carrier that can be bound around a user's arm to hold a handheld video device therein while allowing the user to conveniently watch and operate the handheld video device.

BACKGROUND OF THE INVENTION

With the nowadays highly developed video technology, there are various kinds of portable handheld video devices commercially available in the market. For example, cellular phones, personal digital assistances (PDAs), MP3 players, and GPS (global positioning system) receivers all are very popular portable electronic video products. To enable easy carry thereof, the portable video products are usually compact to have small volume, low profile, and low weight. Some advanced video products are even provided with a touch-screen interface to reduce or even eliminate operating keys from the video products.

These portable video products are frequently carried by users in a purse, pocket, or protective carrier. U.S. Pat. No. 6,182,878 discloses a carrier for portable cellular phones. The carrier may be pivoted about a waist belt, a suspender strap, or the like, and the cellular phone held therein may be extracted therefrom for use at any time. The carrier disclosed in U.S. Pat. No. 6,182,878 may be differently sized for holding electronic devices other than the cellular phone, such as PDA, GPS receiver, etc.

The conventional protective carrier for cellular phones and other electronic video products is designed simply as a carrying device and does not allow the user to operate or watch the screen of the video product when the same is held in the carrier. For example, a doctor at a patient's bedside would usually hold a PDA with left hand to watch the patient's case history, and therefore has only the right hand available for taking care of the patient. The PDA occupying the doctor's one hand would inevitably form an inconvenience to the doctor.

It is therefore tried by the inventor to develop a carrier for handheld device that not only protectively holds a handheld device therein, but also allows a user to watch a screen or operate keys of the handheld device without the need of extracting the handheld device from the carrier.

SUMMARY OF THE INVENTION

A primary object of the present invention is to provide a carrier that can be attached to a user's arm for holding a handheld device therein, so that the user may conveniently watch information shown on a screen of the handheld device without the need of extracting and particularly holding the handheld device with one hand.

To achieve the above and other objects, the carrier for handheld device according to the present invention includes a base and a clear plastic top member connected to the base via a plurality of spaced binding bands with a receiving space formed between them for holding a handheld video device therein, and an arm band extended across and releasably secured to a lower side of the base for binding the carrier around a user's arm. The binding bands are length adjustably connected at a proximal end to peripheral edges of the top member, and are provided on a back side with a hook fastener surface each for releasably securing to loop fastener surfaces provided on the lower side of the base.

The carrier for handheld device according to the present invention may have an access opening formed at any one of four peripheral edges thereof, allowing the user to put or remove the handheld device in or from the carrier easily.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
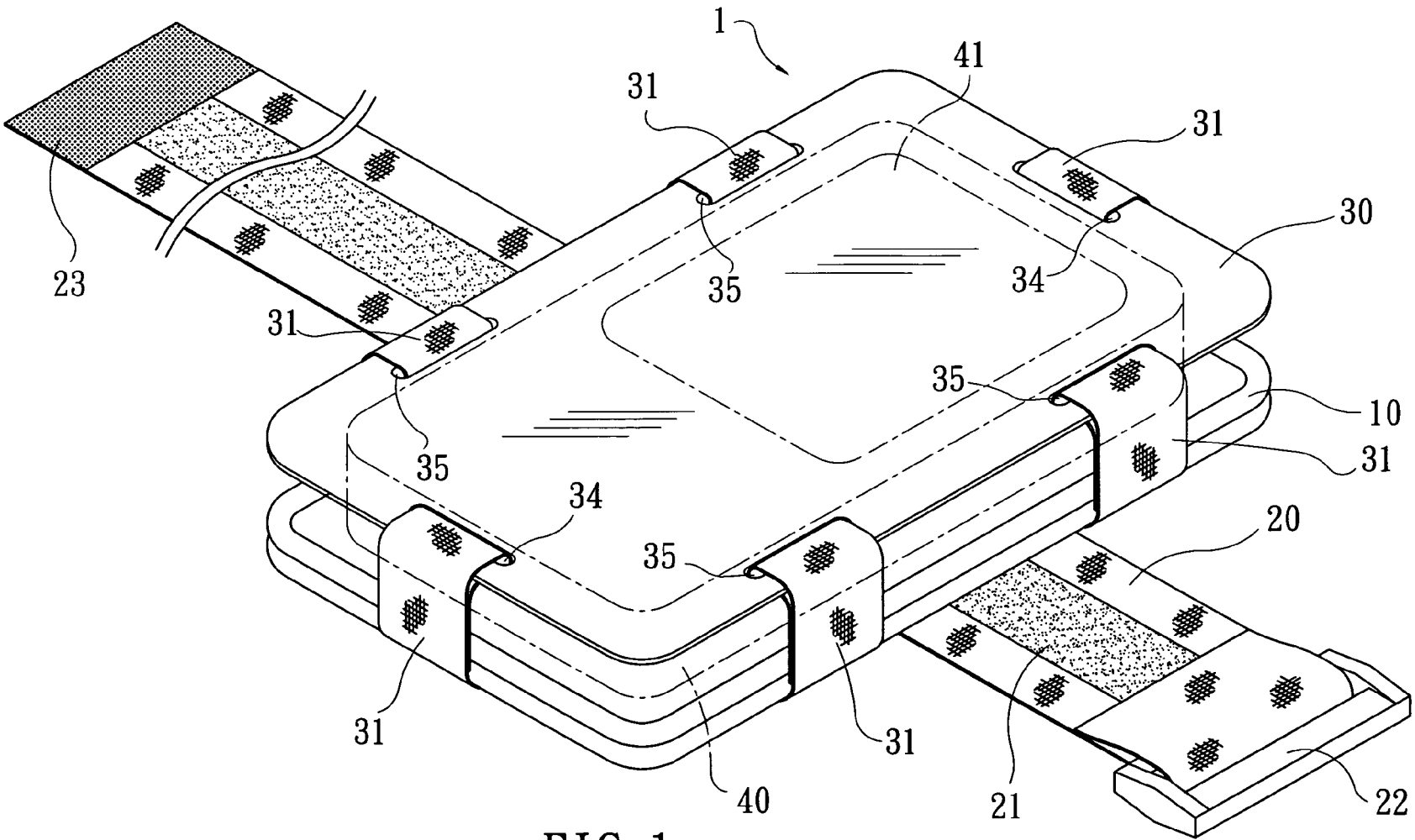
FIG. 1 is an assembled perspective view of a carrier for handheld device according to an embodiment of the present invention.
Figure 2:
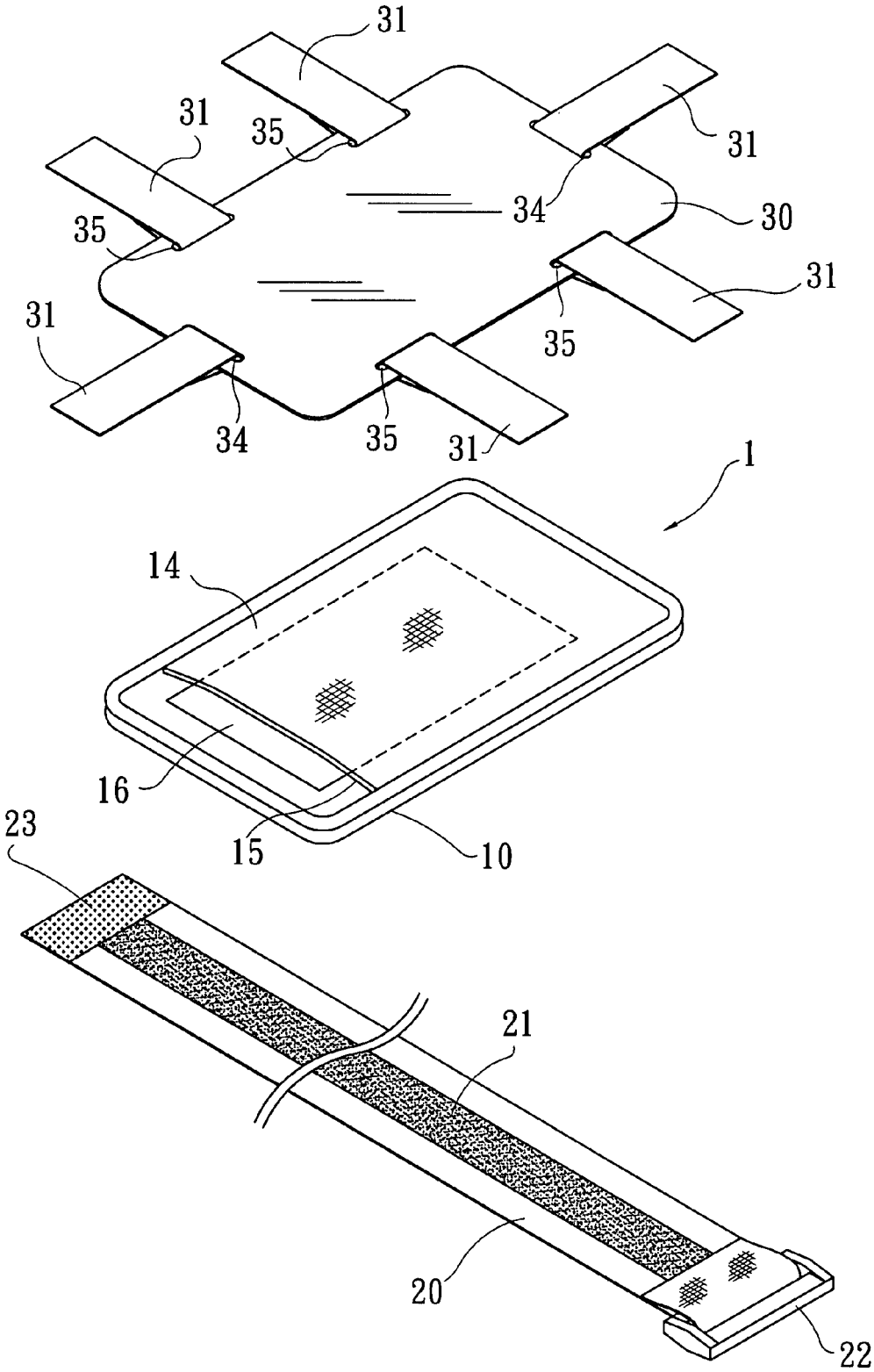
FIG. 2 is an exploded perspective view of the carrier of FIG. 1.

Please refer to FIGS. 1 and 2 that are assembled and exploded perspective views, respectively, of a carrier for handheld device 1 according to an embodiment of the present invention. The carrier 1 is designed for attaching to a user's arm 2 (see FIGS. 5 and 6) to hold a handheld device 40 therein, so that the user may conveniently carry about the handheld device 40 for use at any time. The handheld device 40 may be a handheld video device, such as a cellular phone, a PDA, an MP3 player, a GPS receiver, etc. And, it has been found most handheld video devices available in the market are substantially rectangular in shape. The carrier 1 of the present invention includes a base 10, an arm band 20, and a clear plastic top member 30.

Figure 3:
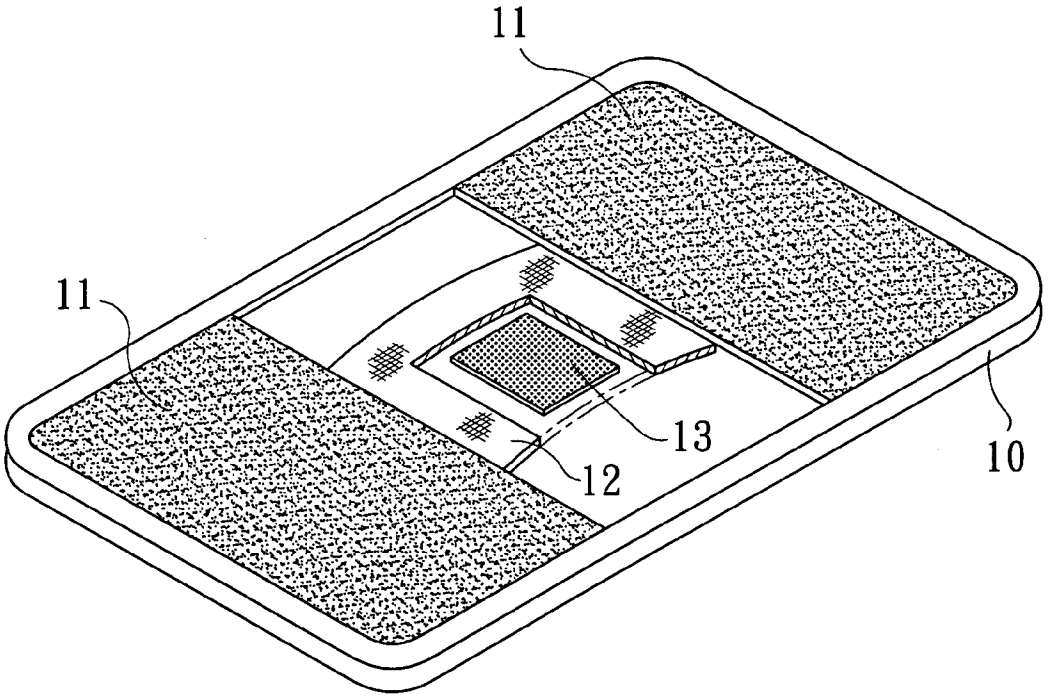
FIG. 3 is a rear perspective view showing a lower side of a base included in the carrier of FIG. 1.

The base 10 is a substantially rectangular plate similar to but slightly larger than the handheld device 40 in size. Please refer to FIG. 3 along with FIGS. 1 and 2. The base 10 has a lower side that is divided into three sections, namely, a front section directed toward a user's hand, a rear section directed toward the user's elbow, and a middle section located between the front and the rear section. The front and the rear section of the lower side of the base 10 are provided with a loop fastener surface 11. The middle section is provided with an axially extended belt 12, two ends of which are fixed to the base 10 so as to define a space between the belt 12 and the middle section of the base 10. A hook fastener surface 13 is invisibly provided on an area of the middle section behind the belt 12.

Figure 5:
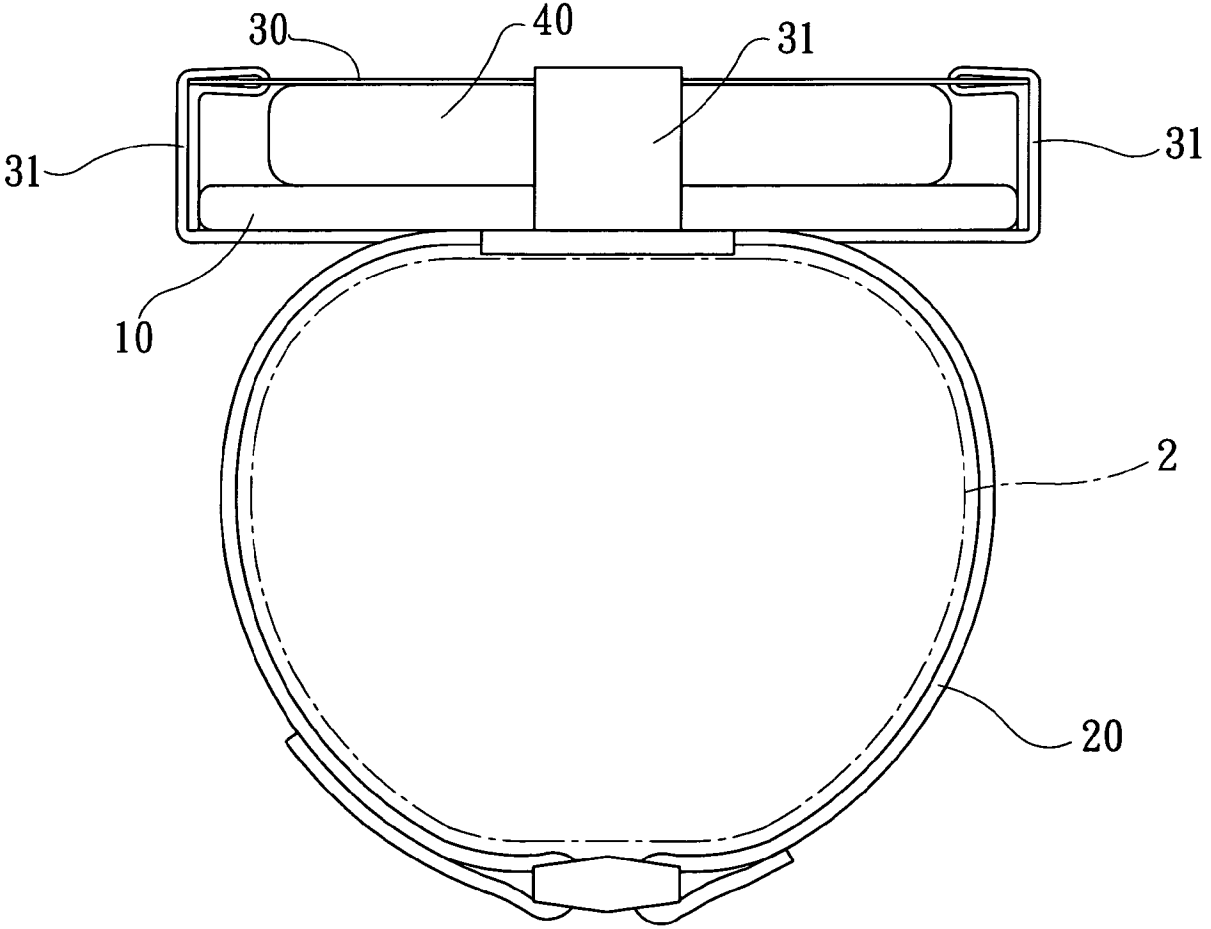
FIG. 5 shows the manner of binding the carrier of FIG. 1 around a user's arm.

The arm band 20 is a long strip adapted to transversely extend through the space defined between the belt 12 and the lower side of the base 10, and is provided on an upper side facing toward the lower side of the base 10 with a loop fastener surface 21 adapted to firmly secure to the hook fastener surface 13 when the arm band 20 is extended through the space behind the belt 12. The loop fastener surface 21 on the arm band 20 may have a long overall length to allow a user to make necessary adjustment of a length of the arm band 20 after the same has been extended through the belt 12. The arm band 20 has a first end provided with a hook fastener surface 23, and a second end provided with a buckle 22, through which the first end of the arm band 20 may be extended. Having been extended through the buckle 22, the first end of the arm band 20 may be bent backward to attach the hook fastener surface 23 to the loop fastener surface 21, so that the arm band 20 is formed into a loop below the base 10, as shown in FIG. 5.

Figure 4:
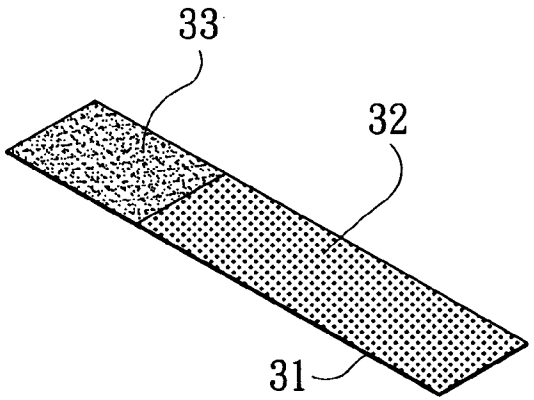
FIG. 4 is a rear perspective view showing a back side of the binding band included in the carrier of FIG. 1.

The clear plastic top member 30 has shape and size the same as or approximate to those of the base 10, and is provided with at least six binding bands 31, namely, a front and a rear binding band 31 located at and extended from a front and a rear edge, respectively, of the top member 30, and two left and two right binding bands 31 located at and extended from a left and a right edge of the top member 30, respectively, corresponding to the front and the rear section at the lower side of the base 10. Please also refer to FIG. 4. Each of the binding bands 31 is provided at a back side with a hook fastener surface 32, so that the six binding bands 31 can be bent downward to releasably secure the hook fastener surfaces 32 to the loop fastener surfaces 11 at the lower side of the base 10 to connect the top member 30 to the base 10 while defining a receiving space between them for holding the handheld device 40 therein.

Figure 7:
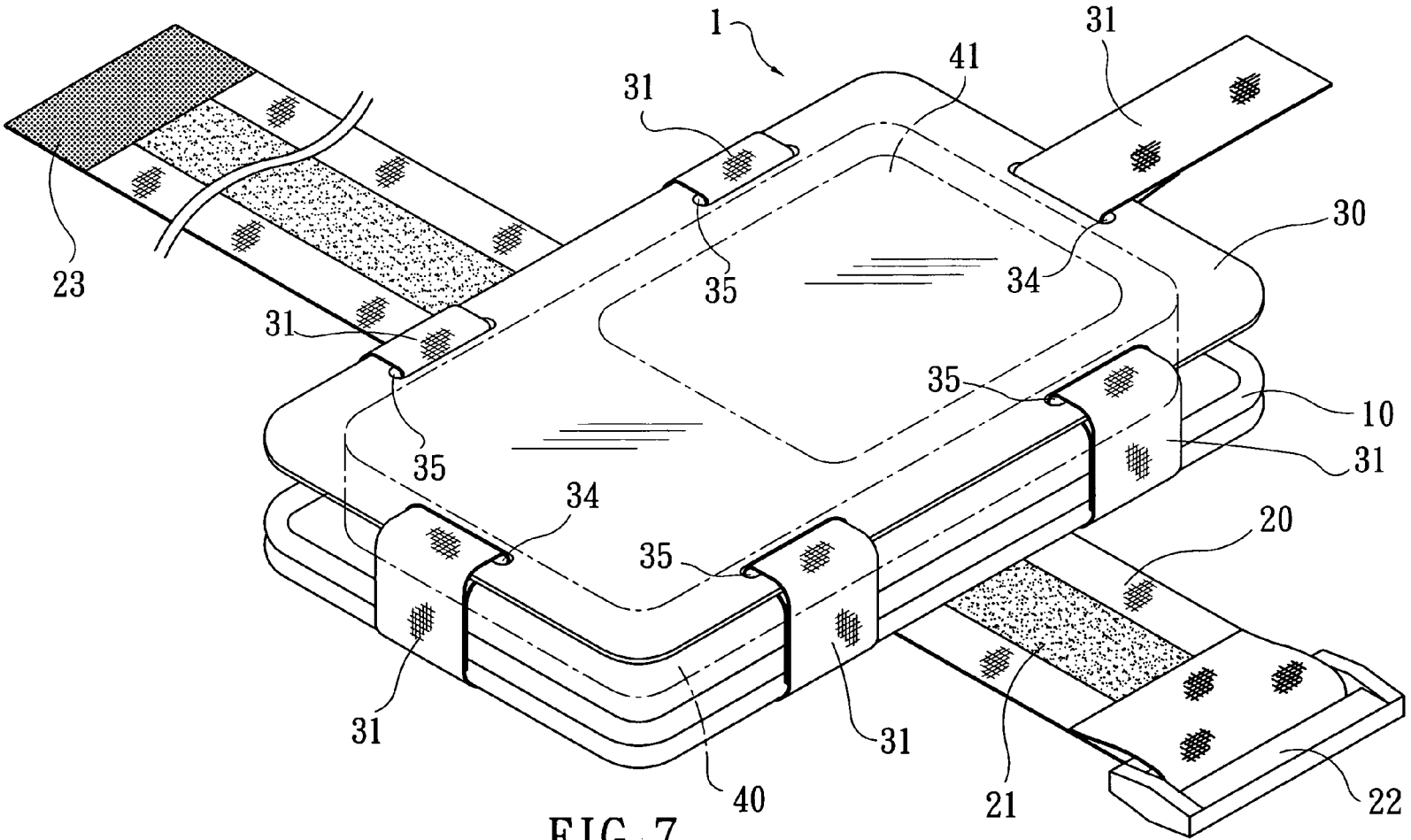
FIG. 7 shows the manner in which a handheld device is put in and removed from the carrier of FIG. 1.

To put the handheld device 40 in the receiving space between the clear plastic top member 30 and the base 10, simply release the front binding band 31 of the top member 30 from the base 10, as shown in FIG. 7, so that an access opening is provided between the front edge of the top member 30 and the base 10, allowing the handheld device 40 to move into the receiving space via the access opening. Then, the front binding band 31 is secured to the loop fastener surface 11 at the lower side of the base 10 again, preventing the handheld device 40 from moving out of the carrier 1. It is understood the access opening may be otherwise provided at the rear, the left, or the right edge of the top member 30 by releasing the rear, the left, or the right binding bands 31 from the base 10, so that the user may put or remove the handheld device 40 in or from the carrier 1 from a position most convenient for him.

Figure 6:
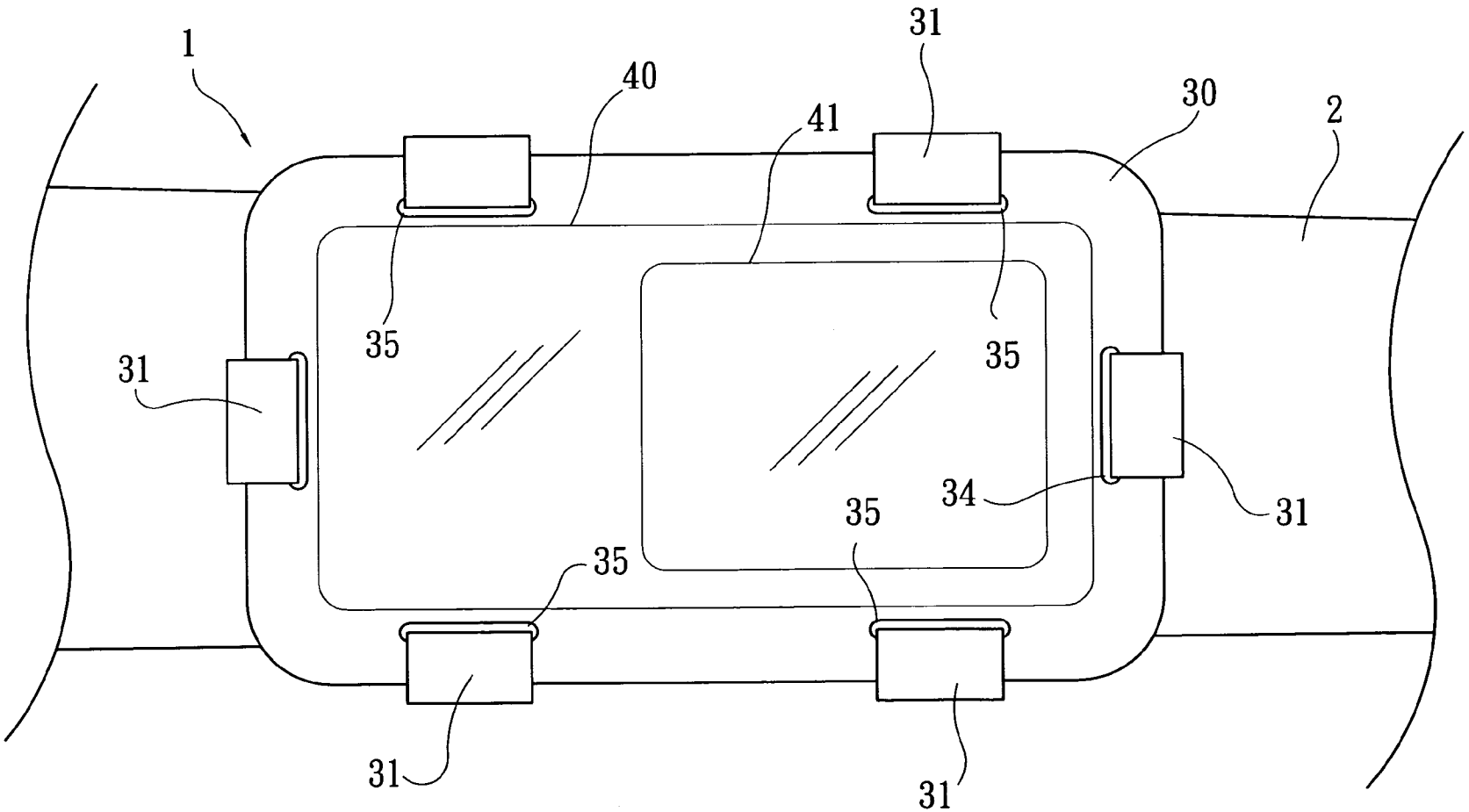
FIG. 6 is a top view of FIG. 5.

Since the top member 30 is made of a clear plastic material, it does not hinder the user from watching any information displayed on a screen 41 provided on the handheld device 40. And, since the carrier 1 is attached to the user's arm 2 using the arm band 20, as shown in FIGS. 5 and 6, the user can easily see the screen 41 of the handheld device 40 simply by raising his arm or looking downward at the screen 41 with the user's two hands available for use. In the case of an advanced handheld device 40 provided with a touch screen 41, the user is allowed to operate the handheld device 40 by touching keys on the screen 41 through the clear plastic top member 30.

The handheld device 40 might have some jacks or slots, such as headphone jack, microphone jack, memory card slot (not shown), etc., provided thereon for connecting to other peripheral devices. Such jacks or slots are frequently provided at left and right sides, and a rear end of the handheld device 40. The carrier 1 has four substantially open peripheral edges except at the spaced binding bands 31, allowing signal cables to be conveniently connected to the jacks or slots on the handheld device 40 held in the carrier 1. The user needs only to release a suitable one of the binding bands 31 from the base 10 to enable successful insertion or removal of a memory card into or from the memory slot provided on the handheld device 40.

The binding bands 31 may be removably connected to the peripheral edges of the top member 30, so that they are independently adjustable in length. For this purpose, an elongate through slot 34 is formed along each of the front and the rear edge of the top member 30 in parallel with the corresponding edge, and two elongate through slots 35 are formed along each of the left and the right edge of the top member 30 in parallel with the corresponding edge; and each of the binding bands 31 is provided on the back side at a proximal end with a loop fastener surface 33 while the rest area on the back side of the binding band 31 is provided with the hook fastener surface 32. Each of the binding bands 31 is extended through a corresponding elongate through slot 34 or 35 with the loop fastener surface 33 secured to the hook fastener surface on the back side of the binding band 31 to form a loop engaged with the elongate through slot 34 or 35, so that the binding band 31 is connected to the edge of the top member 30. When the handheld device 40 to be held in the carrier 1 has a relatively small thickness, the user may cause the loop fastener surfaces 33 of the binding bands 31 to secure to the hook fastener surfaces 32 to form the loops with an increased size, so that the binding bands 31 connected to the elongate through slots 34, 35 have a shortened final length each to facilitate more convenient securing and releasing of the hook fastener surfaces 32 to and from the loop fastener surfaces 11 at the lower side of the base 10.

Figure 8:
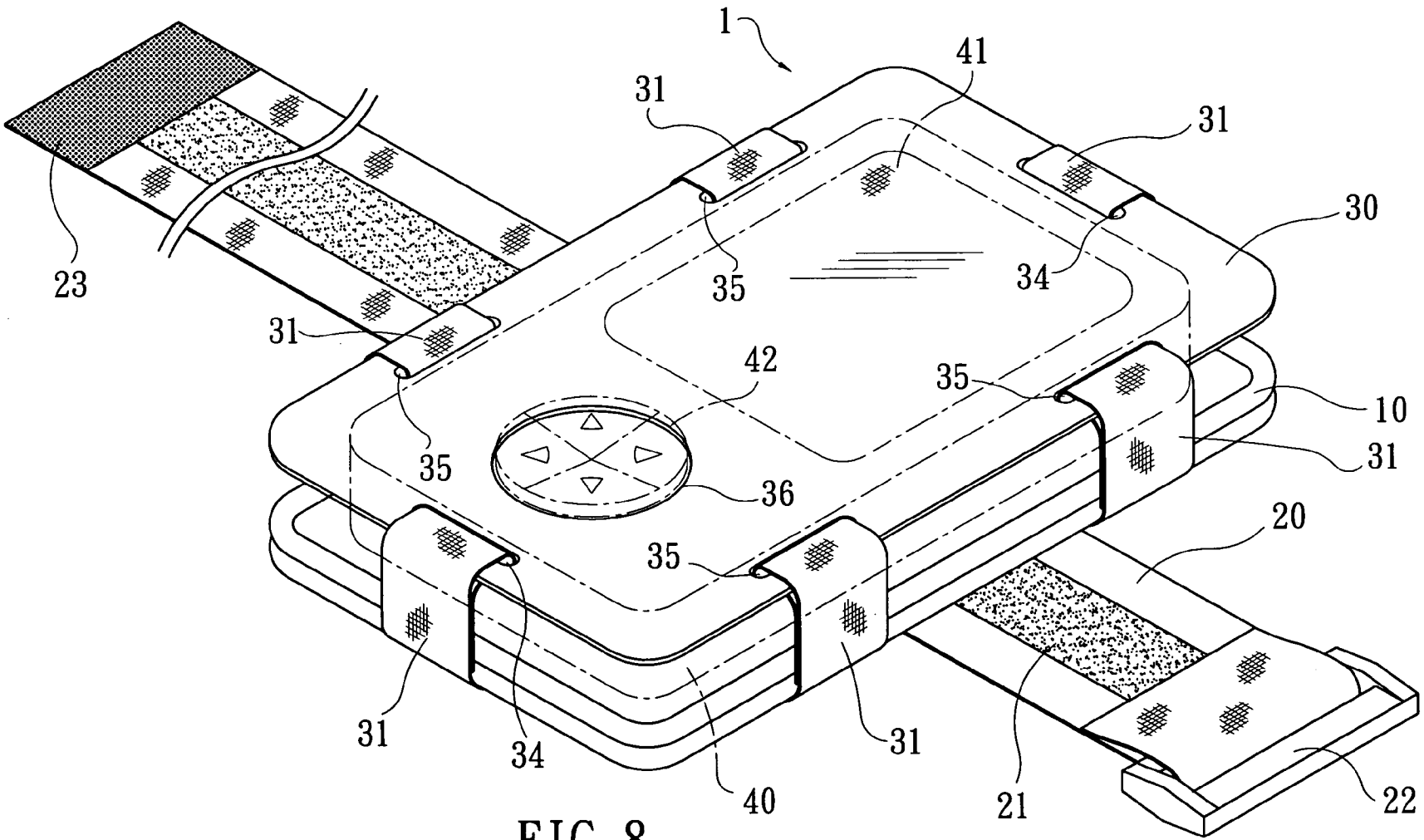
FIG. 8 shows the carrier of the present invention having a clear plastic top member provided with an opening.

The clear plastic top member 30 preferably has a central area with shape and size similar to that of the handheld device 40 held in the carrier 1. As shown in FIG. 8, at least one opening 36 may be formed on the top member 30 to allow operating keys 42 provided on the handheld device 40 to expose at and protruded from the opening 36 to facilitate manipulation of the keys 42 by the user.

Figures 9, 10:
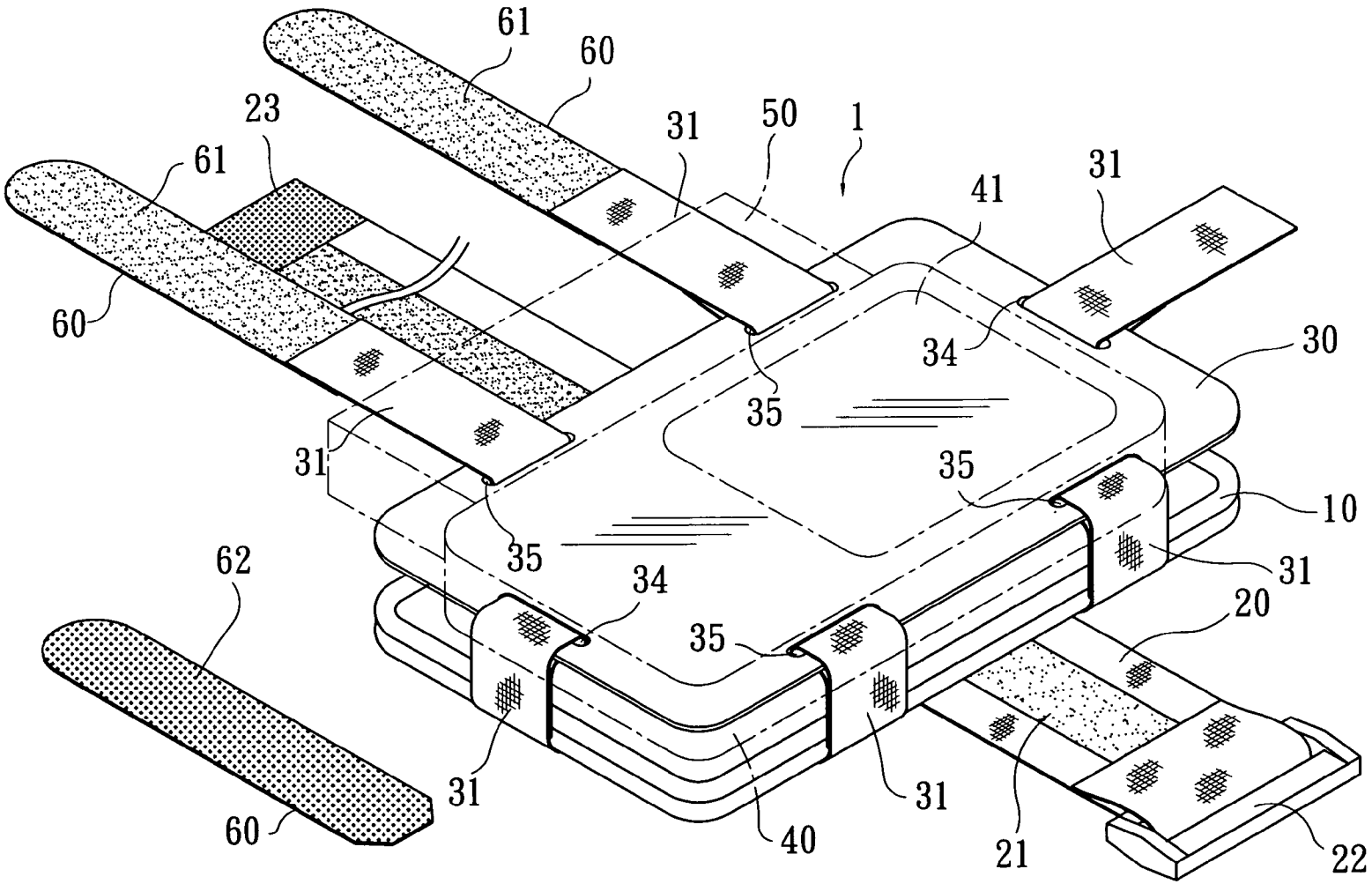
FIG. 9 shows the binding band of the carrier of FIG. 1 may be extended in length by connecting an extension band thereto.
FIG. 10 is a rear perspective view showing a back side of the extension band shown in FIG. 9.

Please refer to FIG. 9. The handheld device 40 held in the carrier 1 and currently in use might have to connect to some other peripheral device 50 which would protruded from the peripheral edges of the carrier 1. In this case, one or more extension bands 60 may be connected to some of the binding bands 31 to increase the length thereof according to actual need. Please also refer to FIG. 10. Each of the extension band 60 is provided on a front side with a loop fastener surface 61 for securing to the hook fastener surface 32 on the back side of the binding band 31, and on a back side with a hook fastener surface 62 for securing to the loop fastener surface 11 on the lower side of the base 10. With the length-extended binding bands 31, the peripheral device 50 protruded from the open peripheral edges of the carrier 1 may also be securely held to the carrier 1.

As can be seen from FIG. 2, the base 10 may be provided on an upper side with a layer of sheet material 14 to form a pocket 15 on the base 10 for conveniently holding some flat things 16 therein, such as credit cards, memory cards, etc.

In the present invention, the loop fastener surfaces and the hook fastener surface provided on the base 10, the binding bands 31, the arm band 20, and the extension bands 60 are complementary releasable fasteners, such as the hook and loop fasteners sold under the mark of VELCRO®.

In brief, the carrier for handheld device according to the present invention not only allows a user to conveniently carry different types of handheld video device, such as a cellular phone, a PDA, or a GPS receiver, but also allows the user to watch information displayed on the screen of the handheld video device and to operate keys provided on the handheld device without the need of extracting the device from the carrier. Therefore, the carrier for handheld device of the present invention is a humanized design and very convenient for use.

What is claimed is:

1. A carrier for handheld device, comprising:

a rectangular base plate having an axially extended belt, an upper side, and a lower side, wherein the lower side is divided into a front section, a middle section, and a rear section, a loop fastener surface covers only the front section and the rear section, the middle section includes a hook fastener surface, and the axially extended belt's two ends are fixed to the base plate and cover the hook fastener surface of the middle section to define a space between the belt and the base;

an arm band being a long strip adapted to transversely extend through the space behind the axially extended belt at the lower side of the base; the arm band being provided on an upper side facing toward the lower side of the base with a loop fastener surface at the lower side of the base when the arm band is extended through the space behind the axial belt; the arm band having a first end provided with a hook fastener surface, and a second end provided with a buckle, through which the first end of the arm band may be extended and then bent backward to secure the hook fastener surface thereof to the loop fastener surface on the upper side of the arm band; and a clear plastic top member being a rectangular sheet member with a first side, a second side, a third side, and a fourth side, wherein the first side is adjacent to the second side and the fourth side, the first side includes a first binding band, the second side provides a second binding band and third binding band, the third side provides a fourth binding band, and the fourth side provides a fifth binding band and a sixth binding band, each of the binding bands being provided on a back side with a hook fastener surface, so that the binding bands may be bent downward to secure the hook fastener surfaces to the loop fastener surfaces on the lower side of the rectangular base plate, and thereby connect the top member to the rectangular base plate with a receiving space defined between the top member and the rectangular base plate for holding a handheld device therein, and the clear plastic top member allows users to touch the handheld device's keys through the clear plastic top member.

2. The carrier for handheld device as claimed in claim 1, wherein the first side has a first elongate through slot, the second side has a second elongate through slot and a third elongate through slot, the third side has a fourth elongate slot, and the fourth side has a fifth elongate through slot and a sixth elongate through slot, wherein the first elongate through slot is parallel to the fourth elongate thorough slot, the second elongate through slot and the third elongate through slot are parallel to the fifth elongate through slot and the sixth elongate through slot, and the binding bands are provided on the back side at respective proximal end with a loop fastener surface; and each of the binding bands being extended through a corresponding elongate through slot with the loop fastener surface thereof secured to the hook fastener surface thereof to form a loop engaged with the corresponding elongate through slot.

3. The carrier for handheld device as claimed in claim 1, wherein the clear plastic top member is provided with at least one opening, via which operating keys provided on the handheld device are protruded from the top member for operating.

4. The carrier for handheld device as claimed in claim 1, wherein the rectangular base plate is provided on an upper side with a layer of sheet material to form a pocket on the base.

5. The carrier for handheld device as claimed in claim 1, further comprising at least one extension band; the extension band being provided on a front side with a loop fastener surface and on a back side with a hook fastener surface; and the extension band connectable to the end of any one of the binding bands by securing the loop fastener surface on the front side of the extension band to the hook fastener surface on the back side of the binding band, and at another end to the lower side of the base by securing the hook fastener surface on the back side of the extension band to the loop fastener surface on the lower side of the base.

* * * * *